United States Patent [19]

Reed

[11] Patent Number: 4,573,217

[45] Date of Patent: Mar. 4, 1986

[54] PROTECTIVE HOOD FOR FIREFIGHTERS

[76] Inventor: Clifford C. Reed, Rte. 6, Box 522, Arcadia, Tex. 77517

[21] Appl. No.: 635,810

[22] Filed: Jul. 30, 1984

[51] Int. Cl.[4] ..... A42B 1/04

[52] U.S. Cl. ..... 2/7; 2/5; 2/84; 2/202; 2/205

[58] Field of Search ..... 2/7, 5, 2, 84, 203, 2/205, 202

[56] References Cited

U.S. PATENT DOCUMENTS

| | | | |
|---|---|---|---|
| 2,709,667 | 5/1955 | Grubb et al. | 2/5 X |
| 4,231,118 | 11/1980 | Nakagawa | 2/7 |
| 4,411,023 | 10/1983 | Dinson | 2/7 |

FOREIGN PATENT DOCUMENTS

| | | | |
|---|---|---|---|
| 0054154 | 6/1982 | European Pat. Off. | 2/5 |
| 7512409 | 12/1976 | France | 2/202 |

OTHER PUBLICATIONS

German publication No. 1,129,431; 5-1962 to Teufel.

Marjory L. Joseph, *Introductory Textile Science,* 3rd ed., 1977, "Aramid", pp. 130-131.

*Primary Examiner*—Werner H. Schroeder

*Assistant Examiner*—J. L. Olds

*Attorney, Agent, or Firm*—Dodge, Bush & Moseley

[57] ABSTRACT

A protective hood adapted for use by a firefighter is disclosed in which a head portion, a lower marginal portion and a flap provide protection not only for the forehead, head and ears but also for the chin and neck of the firefighter. A means for adjustably and releasably fastening the flap to the protective hood is disclosed. The protective hood is fabricated from an exterior material and an interior liner material, so that the two layers of material provide an insulated fire resistant protective hood for the firefighter. The protective hood used in combination with an air pack face mask and a firefighting coat provides complete protection of the head and upper torso of the firefighter.

16 Claims, 5 Drawing Figures

PROTECTIVE HOOD FOR FIREFIGHTERS

BACKGROUND OF THE INVENTION

1. Field of the Invention

This invention relates generally to the field of firefighter safety equipment and more particularly to a protective hood adapted for use by a firefighter especially adapted to protect the neck and chin of the firefighter.

2. Description of the Prior Art

Firefighting has through the ages become specialized. One of these specialized fields of firefighting is interior firefighting. In interior firefighting a firefighter enters a structure to extinguish a flame, or more importantly, to rescue a life.

Along with the development of interior firefighting, the safety equipment used and required for interior firefighting has become more sophisticated.

When a firefigher enters an enclosed structure such as a house or an apartment, the radiant heat and the convected heat is so severe that it prohibits the firefighter from advancing towards the center of the flame. Exposed skin of the firefighter, such as the ears, face, and neck of the firefighter is critical in determining how long a firefighter can withstand the environment of the fire.

Even if the firefighter were to enter the enclosed structure and maintain a working position in which he feels comfortable, sudden and unexpected events occur during a fire that could place the firefighter in a precarious, if not fatal, environment. Events common to firefighting are flashovers (i.e. the sudden spread of flame over an area when it becomes heated to a flash point), backdraft of the fire and smoke explosion. Obviously, firefighters who are not fully protected cannot stay in the same fire environment as long as a firefighter who is fully protected for interior firefighting.

From an economic stand point, the lack of full protection for a firefighter implies increased tax dollars required for firefighters injured while on duty from burns or worse yet, for the death of a firefighter.

Prior art attempts to address the above problems, such as collars on coats and ear protectors sewn into helmets, have not been fully successful in providing protection. Winter liners recommended for use by construction workers, linemen, lumbermen, emergency crews, and firefighters have been available. These liners are provided with a flame retardant material, but the construction of such liners does not protect the chin and neck of the firefighter. These prior art liners are designed primarily for protection from cold weather.

IDENTIFICATION OF OBJECTS OF THE INVENTION

An object of the present invention is to provide a protective hood for interior firefighting wherein said hood when used in combination with a coat and an air pack face mask provides full coverage to the face, head, and neck of the firefighter.

It is another object of this invention to provide a protective hood which is fabricated from materials conducive to firefighting which are heat/fire resistant.

It is another object of this invention to provide a protective hood to be used in combination with existing safety equipment to allow a firefighter to withstand higher temperatures thereby allowing him to advance further into an enclosed structure to better fight the fire and to rescue human life.

It is a further object of this invention to provide a protective hood that, when used in combination with existing firefighting equipment, protects the firefighter from sudden and unexpected conditions in firefighting such as flashovers, backdrafts, and smoke explosions.

It is another object of this invention to provide a protective hood which is manufactured from a washable fabric that is heat/fire resistant and provides interior material that protects against radiant heat, yet light enough so that it does not impair hearing of the firefighter.

SUMMARY OF THE INVENTION

The objects mentioned above as well as other features and advantages resulting from the invention are provided in a protective hood adapted for use by a firefighter comprising a head portion, a lower marginal portion extending below the head portion, a flap permanently attached to the head portion and the lower marginal portion on one side of the flap, and means for adjustably and releasably fastening the other side of the flap to the head portion and the lower marginal portion.

The head portion provides protection of the head of the firefighter. The lower marginal portion provides protection to the neck of the firefighter. The flap provides protection for the chin and the neck of the firefighter. The exterior material and the interior liner material of the protective hood are fire resistant.

According to the invention, the head portion protects the forehead and the ears of the firefighter. The lower marginal portion and the flap overlapped by a coat of the firefighter protect the neck and chin of the firefighter from heat and flame.

According to the invention, the means for releasably fastening the free end of the flap to the head portion comprises a non-metallic and fire resistant material. The means for fastening comprises pile strips permanently attached to the interior liner material of the flap and corresponding hook strips permanently attached to the exterior material of the head portion and the lower marginal portion.

The exterior material of the protective hood is fabricated from a washable material that retains its fire resistant quality after washing. The interior liner material is fabricated of an oxidized fiber which will neither burn nor melt in air.

In combination with a firefighting coat and an air pack face mask, improved firefighting equipment is provided wherein the improvement comprises a protective hood, the head portion and the flap of which overlap the face mask so that no skin of the face is exposed. The lower marginal portion of the hood is overlapped by the coat of the firefighter so that no skin of the neck and the chin is exposed to the flame and heat.

BRIEF DESCRIPTION OF THE DRAWINGS

The objects, advantages, and features of the invention will become more apparent by reference to the drawings which are appended hereto and wherein like numerals indicate like parts, and wherein an illustrated embodiment of the invention is shown, of which.

DETAILED DESCRIPTION OF THE INVENTION

Figure 1:
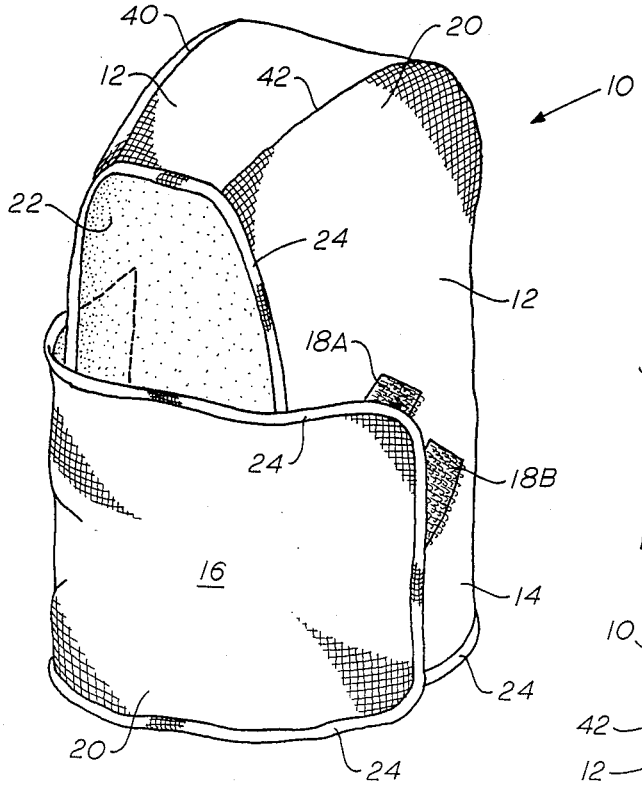
FIG. 1 is a perspective front view of the protective hood of the present invention.
Figure 2:
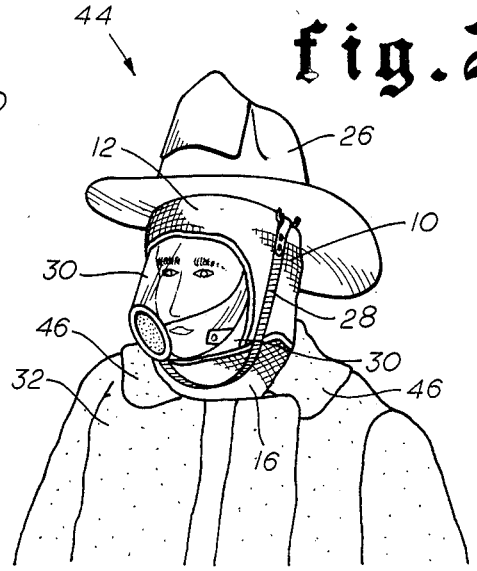
FIG. 2 is a perspective view of a firefighter attired in firefighting equipment including the protective hood of the present invention.
Figure 3:
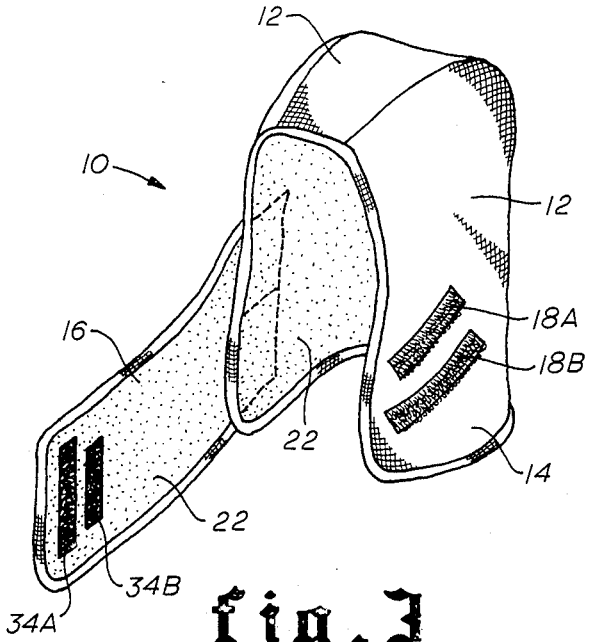
FIG. 3 is a perspective view similar to the enlarged FIG. 1 illustrating the flap of the protective hood in an open position.
Figure 4:
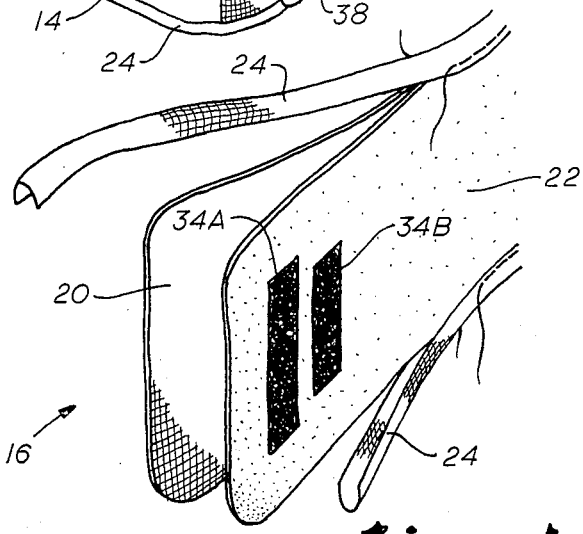
FIG. 4 is a fragmentary exploded view of the flap of the protective hood.

The protective hood, generally designated 10, is shown in detail in FIGS. 1–5. Referring specifically to FIGS. 1 and 4, the protective hood includes a head portion 12 having a lower marginal portion 14 extending below the head portion 12, a flap 16, a fastening means 18A, 18B, 34A, and 34B, an exterior material 20, an interior liner material 22, and trim 24.

Referring now to FIG. 2, the protective hood 10 is illustrated in combination with other firefighting protective equipment such as a firefighting helmet 26 having a strap 28 securing the helmet to the firefighter, an air pack face mask 30, and a firefighting coat 32. FIG. 2 best illustrates the head portion 12 adapted to cover the forehead and ears of the firefighter 44.

Turning next to FIG. 3, a perspective view similar to enlarged FIG. 1, illustrates the flap 16 in the open position in order to better illustrate the interior liner material 22 and the pile strips 34A and 34B. The protective hood 10 as illustrated in FIG. 3 has a head portion 12 and a lower marginal portion 14. The hook strips 18A and 18B permanently attached to the exterior material 20 of the hood 10 in combination with the pile strips 34A and 34B permanently attached to the interior liner material 22 of the flap 16 provide an adjustable and releasable fastening means for fastening the flap 16 to the head portion 12. In the preferred embodiment, the pile strips 34A, 34B are permanently sewn onto the flap 16 in a parallel relationship and the hook strips 18A and 18B are similarly permanently sewn to the protective hood 10 in a parallel relationship. The strips 18A and 18B are sewn at approximately 45 degrees to the horizontal and the strips 34A and 34B are sewn in a vertical plane. It is to be understood that the placement of the hook strips and pile strips could be reversed and still achieve the fastening means required.

Turning now to FIG. 4, the flap 16 is illustrated in an exploded fragmentary view to better illustrate the construction and the materials used in the construction of the hood 10. In the preferred embodiment, the interior liner material 22 is fabricated from a fire resistant material such as KEVLAR, a trademarked material of the E. I. DuPont De Nemours & Company, or a three ounce pajama check NOMEX, a trademarked material of the E. I. DuPont De Nemours & Company. The exterior material 20 is preferably fabricated from NOMEX, a trademarked fire resistant duck type material of the E. I. DuPont De Nemours & Company. Also illustrated in FIG. 4 is the exterior material 20, which covers the interior liner material 22. This two layered construction, consisting of the interior liner material 22 and the exterior material 20 is typical for the construction of the protective hood 10 throughout.

A fire resistant trim 24, also a duck type material similar to the exterior material 20, is provided throughout the construction of the protective hood 10 and is sewn with fire resistant thread so as to join the two layers of materials 20 and 22 as best seen in FIG. 4. Also shown in FIG. 4 is an enlarged illustration of the parallel vertical strips 34A and 34B. In the preferred embodiment the strips 34A and 34B are sewn through both the interior liner material 22 and the exterior material 20, thereby securely attaching them to flap 16.

Figure 5:
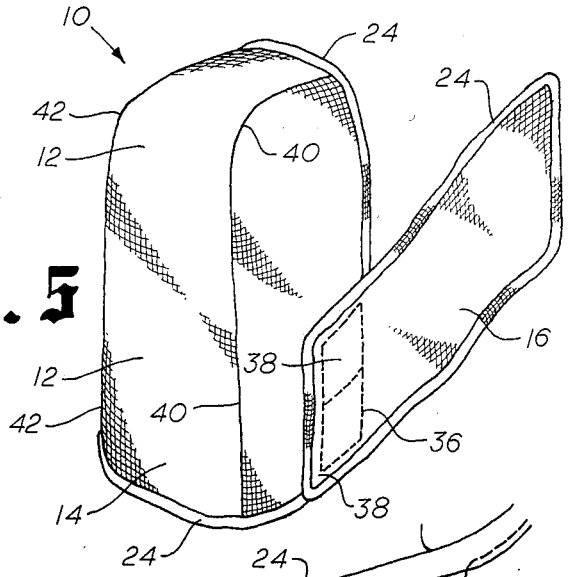
FIG. 5 is a perspective rear view of the present invention illustrating the permanent fastening of the flap to the hood and the lower marginal portion.

Turning now to FIG. 5, a perspective rear view of the protective hood 10 better illustrates the flap 16 and the lower marginal portion 14 of the hood 10. The lower marginal portion 14 protects the back and side of the neck of the firefighter. FIG. 5 best illustrates the pattern for sewing the thread 36 to permanently attach the end 38 of the flap 16 to the protective hood 10. In the preferred embodiment, the permanent fastening means is a fire resistant thread 36 sewn as illustrated through both the flap 16 and the head portion 12 and the lower marginal portion 14 as is best shown in FIGS. 3 and 5.

The use of velcro hook and pile fasteners as an adjustable and releasable fastening means is used in the preferred embodiment because of its nonconductive and fire resistant qualities. The relationship of the strips 18A and 18B to the strips 34A and 34B allows a wide range of adjustability in the fastening of the flap 16. This adjustability is important to allow the hood 10 to be used with different head sizes and different face masks.

In the preferred embodiment the construction of the protective hood 10 presents seams 40 and 42 running from the front forehead section of the protective hood 10 to the back of the hood, including the lower marginal portion 14 of the protective hood 10 as is best illustrated in FIGS. 1 and 5.

USE AND OPERATION

The protective hood 10 used in combination with the existing firefighting equipment can provide full coverage for the firefighter 44 as is best shown in FIG. 2.

The firefighter about to enter an environment where full protection is required, places the air pack face mask 30 over his face, then places the protective hood 10 with the flap 16 in the open position as shown in FIG. 3 on his head, so that the forehead portion and the ears portion of the head portion 12 overlays the air pack face mask 30. The firefighter 44 then adjustably secures the strips 34A and 34B of flap 16 to the strips 18A and 18B so that the upper portion of the flap 16 overlays the mask 30 thereby fully covering the head and neck of the firefighter 44.

The lower marginal portion 14 of the hood 10 in combination with the lower portion of the flap 16, as is best illustrated in FIGS. 1, 3, and 5, provide complete protection of the lower neck of the firefighter 44. The flap 16 is designed so that its bottom end is of the same length with the bottom end of the lower marginal portion 14, as best shown in FIG. 5, thereby providing complete coverage of the chin and neck of the firefighter 44. The firefighter then puts his coat 32 on so that collar 46 of the coat 32 overlays the protective hood 10. The lower marginal portion 14 and the flap 16 are of such a length that the firefighter may turn his head while working and the coat 32 will continue to overlap the protective hood 10.

The helmet 26 is placed over the protective hood 10, as illustrated in FIG. 2, and the strap 28 is secured under the chin of the firefighter 44 and over the flap 16 of the protective hood 10. This combination of the coat 32, the protective hood 10, the air pack face mask 30, and the helmet 26, provides complete protection for a firefighter as is shown in FIG. 2. The helmet 26 is used mainly in this combination to protect the head from blows and falling objects.

Various modifications and alterations in the described structures will be apparent to those skilled in the art of the foregoing description which does not depart from the spirit of the invention. For this reason, these changes are desired to be included in the appended claims. The appended claims recite only the limitation to the present invention and the descriptive manner which is employed for setting forth the embodiments and is to be interpreted as illustrative and not limitative.

What is claimed is:

1. A protective hood adapted for use with a face mask by a firefighter, comprising:

a fire resistant head portion adapted to cover the forehead and ears of the firefighter, a fire resistant lower marginal portion extending sufficiently below said head portion to cover the lower neck of the firefighter, a fire resistant flap permanently attached to said head portion and said lower marginal portion on one end of said flap, said flap extending sufficiently below said head portion to cover the chin and the neck of the firefighter, and non-metallic and fire resistant means for adjustably and releasably fastening the other end of said flap to said head portion and said lower marginal portion, whereby said flap can be adjusted to securely overlap the face mask, and whereby the protective hood in cooperation with the face mask aids in the protection of the chin, head, face and neck of the firefighter.

2. The hood of claim 1 wherein said hood is constructed of two layers including, an exterior material, and an interior material.

3. The hood as claimed in claim 1, wherein said lower marginal portion and said flap are sufficiently long so that they may be overlapped by a coat of the firefighter so that no skin of the neck and chin of the firefighter is exposed.

4. The hood as claimed in claim 2, wherein said means for fastening comprises a pile strip permanently attached to the interior material of the flap and a cooperating hook strip permanently attached to the exterior material of the head portion and the lower marginal portion.

5. The hood as claimed in claim 2, wherein said exterior material is fabricated from a washable material that will retain its fire resistant quality after washing.

6. The hood as claimed in claim 2, wherein said interior material is fabricated from a three ounce pajama check fire resistant material.

7. The hood as claimed in claim 2, wherein said exterior material is fabricated from a fire resistant duck type material.

8. In combination with firefighting equipment of the type wherein a firefighting coat and an air pack face mask are provided for protection of a firefighter, an improved hood comprising:

a fire resistant head portion, said head portion providing protection of the head, ears and upper forehead of the firefighter, said head portion overlapping said face mask, a fire resistant lower marginal portion extending below said head portion, said lower marginal portion providing protection for the back and sides of the neck of the firefighter, said coat overlapping the bottom of said lower marginal portion, a fire resistant flap permanently attached to said head portion and said lower marginal portion on one end of said flap, said flap providing protection for the chin and the front of the neck of the firefighter, said flap overlapping the bottom of said face mask, said coat overlapping the bottom of said flap, and non-metallic and fire resistant means for adjustably and releasably fastening the other end of said flap to said head portion and said lower marginal portion, whereby the protective hood in combination with said face mask and said coat provides protection for the chin, head, face and neck of the firefighter.

9. The improved hood of claim 8 wherein said hood is constructed of two layers including, an exterior material, and an interior material.

10. The improved hood as claimed in claim 9, wherein said means for fastening comprises a pile strip permanently attached to the interior material of the flap and a cooperating hook strip permanently attached to the exterior material of the head portion and the lower marginal portion.

11. The improved hood as claimed in claim 9 wherein said means for fastening comprises a plurality of pile strips approximately vertically attached to the interior material of the flap and a plurality of cooperating hook strips permanently attached at approximately 45° from the horizontal to the exterior material.

12. The improved hood as claimed in claim 9, wherein said exterior material is fabricated from a washable material that will retain its fire resistant quality after washing.

13. The improved hood as claimed in claim 9 wherein said exterior material is fabricated from a fire resistant duck type material.

14. The improved hood as claimed in claim 9, wherein said interior material is fabricated from a three ounce pajama check fire resistant material.

15. The improved hood as claimed in claim 8, wherein said fastening means comprises hook and pile fasteners.

16. A protective hood adapted for use with an air pack face mask by a firefighter, comprising:

a fire resistant head portion adapted to cover the forehead and ears of the firefighter, a fire resistant lower marginal portion extending sufficiently below said head portion to cover the lower neck of the firefighter, at least one fire resistant flap, one end of said flap fixedly positioned adjacent said head portion and said lower marginal portion, non-metallic and fire resistant means for adjustably and releasably fastening the free end of said flap, whereby said fastened flap can be adjusted to securely overlap the face mask while sufficiently covering the chin and neck of the firefighter, whereby the protective hood in combination with said face mask provides protection for the chin, head, face and neck of the firefighter.

* * * * *